US005249993A

United States Patent [19]

Martin

[11] Patent Number: 5,249,993

[45] Date of Patent: Oct. 5, 1993

[54] WEED RESISTANT BOAT PROPELLER

[76] Inventor: Roland V. R. Martin, 511 E. Del Monte Ave., Clewiston, Fla. 33440

[21] Appl. No.: 733,084

[22] Filed: Jul. 19, 1991

[51] Int. Cl.[5] ..... B63H 1/28

[52] U.S. Cl. ..... 440/73; 416/223 R; 416/234; 416/245 A; 416/244 B

[58] Field of Search ..... 440/48, 49, 73; 416/176, 223 R, 234, 244 A, 244 B, 247 A

[56] References Cited

U.S. PATENT DOCUMENTS 885,174 4/1908 Perkins ..... 416/234

4,482,298 11/1984 Hannon et al. ..... 416/234

4,775,297 10/1988 Bernauer ..... 416/223

*Primary Examiner*—Jesus D. Sotelo

*Attorney, Agent, or Firm*—William E. Noonan

[57] ABSTRACT

A weed resistant boat propeller is disclosed. The propeller includes a generally circular hub that is adapted for mounting to and being rotatably driven by a boat motor. There are a plurality of blades mounted to a circumferential surface of the hub and extending therefrom in a spiral configuration. Each blade includes a curved leading edge that has an arc $dy/dx<1$ for the entire length of the leading edge.

8 Claims, 5 Drawing Sheets

WEED RESISTANT BOAT PROPELLER

FIELD OF THE INVENTION

This invention relates to a weed resistant boat propeller and, in particular, to a weedless propeller that is well suited for relatively low speed use, such as in trolling motors.

BACKGROUND OF THE INVENTION

A need has long existed for an effective boat propeller that resists entanglement with weeds and other underwater plant growth. This need is particularly acute for fishing boats that utilize shallow lakes and waterways. Typically, such vessels employ relatively low speed trolling motors that permit them to be slowly but deliberately maneuvered while the occupants of the boat continue to fish. The conventional propellers employed by such motors have a strong tendency to become wrapped with weeds, particularly near the root of each propeller blade, which is the slowest moving portion of the blade. This can cause a significant loss of power and if severe enough can cause the motor to stall. At a minimum, the boater then incurs the delay and inconvenience of having to raise the motor and untangle the weeds therefrom.

Various attempts have been made to achieve weedless propeller operation. Weeds can be effectively cut through and pushed aside if a high speed motor is employed. However, such motors are likely to frighten fish and do not allow for slow paced trolling movement. Therefore, they are generally undesirable for use in many fishing boats.

Alternatively, cages have been mounted around the propeller. Unfortunately, such devices are themselves easily clogged by weeds. As a result, the propeller cannot generate sufficient thrust to properly power the boat.

As described in Hannon, U.S. Pat. No. 4,482,298, the configuration of the propeller has been specifically constructed in an attempt to provide weedless operation. In particular, the device of that patent employs an elongate hub that purports to provide an axial flow velocity that is greater than the tangential velocity of the hub. As a result, the residence time of the weeds about the hub is supposedly reduced so that entanglement is minimized. Notwithstanding the above, the Hannon device is still prone to entanglement, particularly at very low speed operations. Each of the blades of that device employs a curved leading edge having an arc or sweep that is fairly steep. As used herein, "blade arc" refers to the rate of positional change of the leading edge of the blade radially from the root to the tip relative to the positional change of the blade circumferentially from the leading edge to the trailing edge along an arc that is concentric with the hub. This arc may be defined by the formula dy/dx wherein dy denotes the radial change and dx denotes the circumferential change in the position of the blade's leading edge. At any given point along the leading edge the blade arc is determined by the slope of the line tangent to that point. In particular, in Hannon as well as in all other conventional propeller blades, the arc $dy/dx>1$ along at least a portion of the leading edge. When such a blade arc encounters weeds it generates considerable friction, which is likely to cause the weeds to entangle the blades. This problem is exacerbated because the steep blade arc is located proximate the root of the blade, which is already slowest moving portion of the blade. Again, weed entanglement may be reduced by maintaining a high speed and the Hannon propeller is, in fact, designed primarily for use with a relatively high speed motor. However, that device does not exhibit optimally efficient weedless performance at very low trolling motor speeds on the order of 1100 rpm or less.

SUMMARY OF THE INVENTION

It is therefore an object of this invention to provide a boat propeller that exhibits a much improved weed resistant operation, even at relatively low speeds.

It is a further object of this invention to provide a boat propeller that wedges rather than cuts through weeds and underwater plant growth and which effectively resists entangling with weeds proximate the root of each propeller blade.

It is a further object of this invention to provide a weedless propeller that exhibits improved power and thrust at very low speeds.

It is a further object of this invention to provide a weedless propeller that is particularly effective for use in trolling motors.

This invention results from a realization that a much improved low speed weedless propeller operation is achieved by wedging the propeller blade through the underwater plant growth rather than simply cutting through the weeds. This invention results from the further realization that such a wedging action may be effectively accomplished by employing a blade whose leading edge has a blade arc $dy/dx<1$ for the entire length of the leading edge.

This invention features a weed resistant boat propeller including a generally circular hub adapted for mounting to and being rotatably driven by a boat motor. There are a plurality of blades mounted to a circumferential surface of the hub and extending therefrom in a spiral configuration. Each blade includes a curved leading edge that has an arc $dy/dx<1$ for the entire length of the leading edge.

In a preferred embodiment, the blade further includes a trailing edge, a root portion extending at least 180 degrees along the circumferential surface of the hub between the leading and trailing edges and a tip portion at a distal end of the blade between the leading and trailing edges. A pair of blades are preferably disposed symmetrically about the hub such that the leading edge of each blade joins its respective root forwardly, with respect to the direction of travel of the hub, of a point where the trailing edge of the other blade joins the root portion of the other blade. The blade elements may be disposed such that the root portions of the blade elements completely encircle the hub. Preferably, the leading edge of each blade extends for at least 130 degrees about the circumferential surface of the hub.

This invention also features a method of achieving weed resistant water craft propulsion. A weed resistant propeller, as described above, is operably mounted to a boat motor. The hub of the weed resistant propeller is then rotatably driven at a speed of 200 rpm–1100 rpm such that the blades generate a forward thrust to propel the boat through the water while resisting entangling with weeds.

DISCLOSURE OF PREFERRED EMBODIMENTS

Other objects, features and advantages will occur from the following description of a preferred embodiment and the accompanying drawings, in which.

Figure 1:
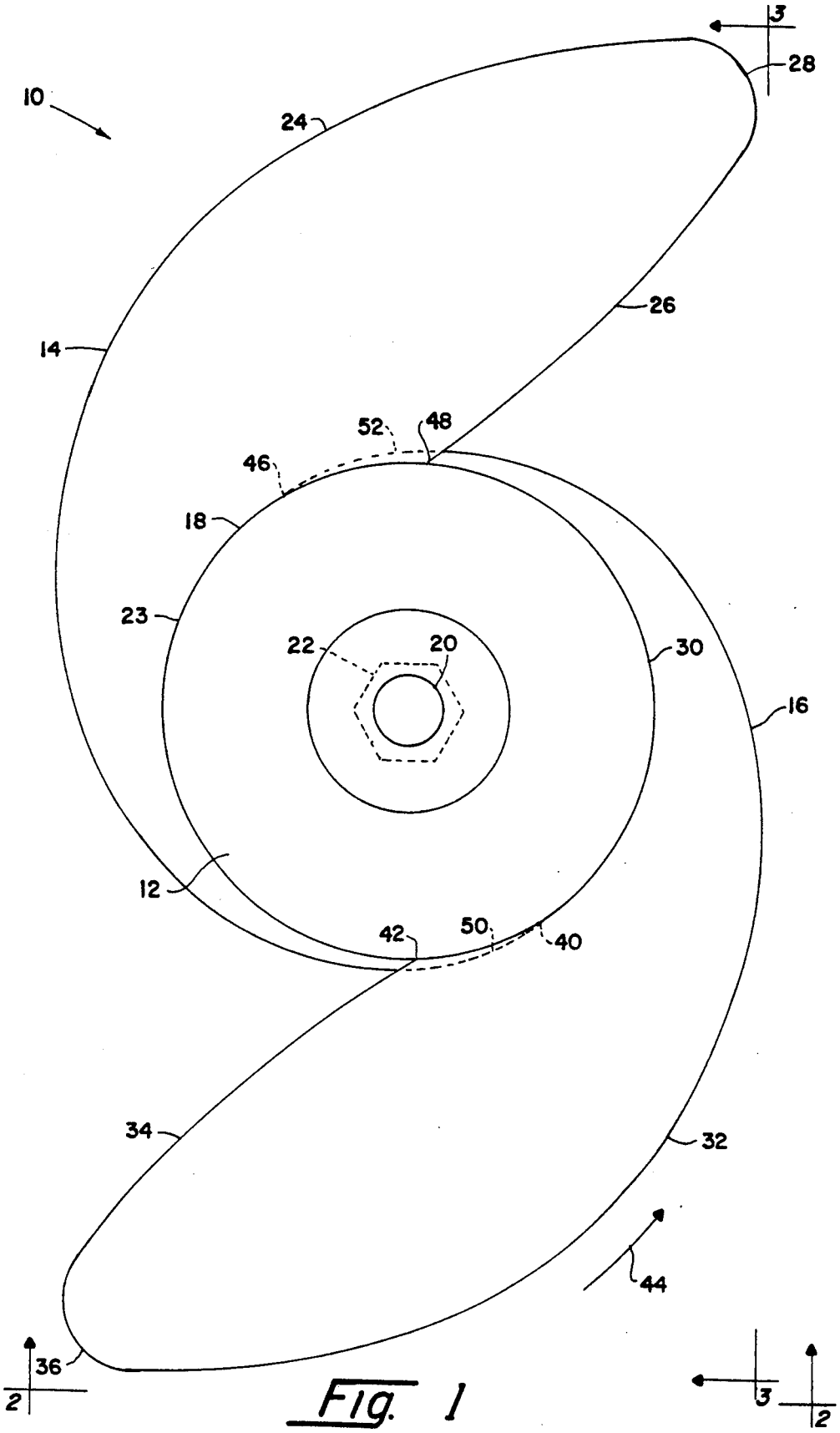
FIG. 1 is an elevational front view of a weed resistant propeller according to this invention.

The weed resistant propeller of this invention is accomplished by mounting to the circumferential surface of a generally circular hub a plurality of uniquely shaped blades. More particularly, each of the blades extends from the hub in a spiral configuration and includes a curved leading edge that has an arc $dy/dx<1$ for the entire length of the leading edge. This blade configuration permits the blades to wedge through underwater weeds at a very low speed of 1100 rpm and less, such that the plant growth is pushed aside from the root to the tip of each blade. The weeds are then cast away from the propeller without significant entanglement.

As used herein, dy refers to the change in position of a selected segment of the leading edge in a radial dimension and dx refers to the change of position of that segment along an arc that extends from the leading edge to the trailing edge and is concentric with the hub. The blade arc may also be determined at any selected point along the curved leading edge by determining the slope of the line tangent to that point.

The weedless operation may be improved further through the use of several other unique structural features of this propeller. In particular, a pair of blades may be mounted symmetrically to the hub such that the blades completely encircle the hub. In this manner, each blade typically includes a leading edge, a root portion that extends greater than 180 degrees along the circumferential surface of the hub between the leading and trailing edges and a tip portion at the distal end of the blade between the leading and trailing portions. Preferably these blades are disposed about the hub such that the leading edge of each blade joins its respective root portion forwardly of the point where the trailing edge of the other blade joins its root portion. Accordingly, the blade elements are disposed such that the root portions of the blade elements completely encircle the hub. Moreover, the subject propeller blades uniquely extend at least 130 degrees and preferably 160 degrees about the hub of the propeller.

The design of this invention is quite distinguishable from standard propeller blades, and particularly from those that are presently used in trolling motors. Most significantly, in standard propeller blades the leading edge of the blade exhibits a blade arc of at least 1, at some point along the blade. This usually occurs proximate the root of the blade. Such a relatively steep blade arc tends to encounter underwater plant growth in a relatively blunt manner. As a result, plants tend to entangle at that point in the blade. This problem is compounded because the steep blade arc is usually exhibited near the root where the rotational speed of the propeller is its slowest. Furthermore, most conventional blades exhibit a series of gaps between the respective blades and do not fully encircle the hub. The gaps contribute to weed entanglement and further complicate operation of the propeller. None of the prior propeller blades exhibit 160 degree leading edges. Rather, the device of the Hannon patent has a leading edge that extends approximately 75 degrees about the hub.

In contrast, applicant's propeller employs blades that typically have a blade arc of significantly less than 1 along the entire length of the blade. The blades do not bluntly encounter the weeds. Rather they wedge through the weeds and push them effectively aside, even at low speeds. The present invention also eliminates circumferential gaps between the blades so that snagging is reduced even more. And, the unique elongated extension of the leading blade edge of the present invention enhances the wedging action likewise and contributes to the improved weedless operation of this invention.

Tests have shown that the boat propeller of this invention provides for effective weedless operation at relatively low propeller speeds of as low as 200–300 rpm. At the same time, the configuration of the propeller has been shown to provide thrust which is comparable, if not better, than higher speed propellers that are presently on the market. Accordingly, this propeller is particularly effective for relatively low speed motor operations, such as those required in trolling motors. Adequate power and weedless operation are achieved at a relatively low rpm. As a result, fish are not unduly frightened and fishing is improved.

There is shown in FIG. 1 a weed resistant propeller 10 that is adapted for mounting to and being rotatably driven by various conventional motors. Propeller 10 is particularly suited for use in connection with trolling motors, such as are used in shallow water fishing applications. In particular, propeller 10 includes a generally circular hub 12 having a generally annular circumferential surface 18. A pair of propeller blades 14 and 16 are secured to circumferential surface 18 of hub 12 and extend therefrom in a spiral configuration. As best shown in FIG. 1, hub 12 includes a central opening 20 that permits the hub to be mounted to a boat motor in a conventional manner. When so mounted, the propeller is secured in place by a standard nut 22 or other known locking means.

Figure 2:
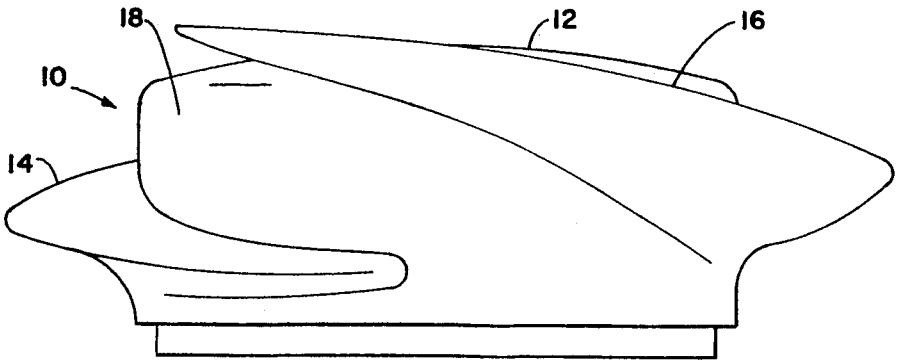
FIG. 2 is an elevational side view taken along line 2—2 of FIG. 1.
Figure 3:
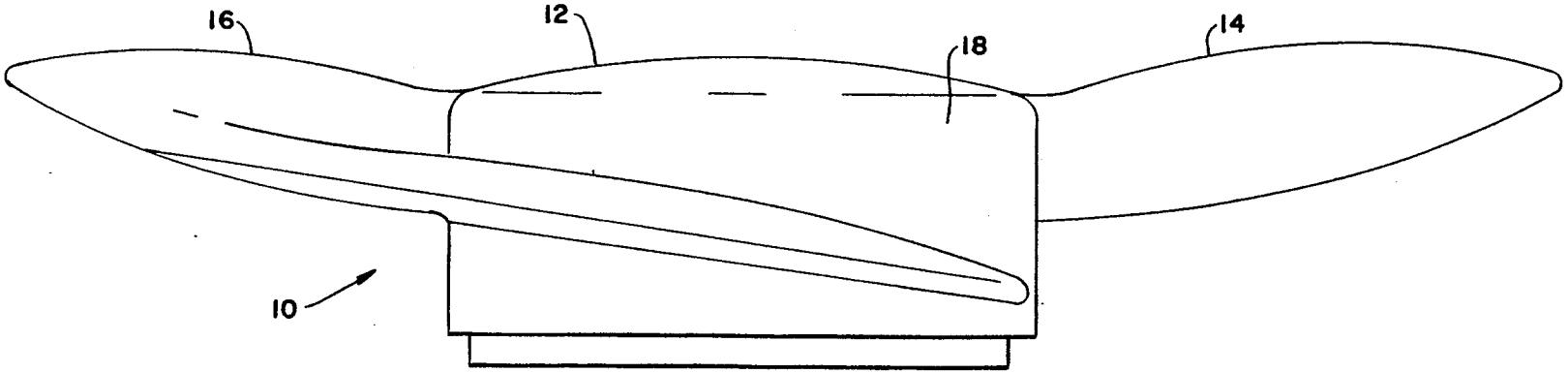
FIG. 3 is an elevational side view taken along line 3—3 of FIG. 1.

Blades 14 and 16 are disposed symmetrically about hub 12. More particularly, blade 14 is joined along a root portion 23 to circumferential hub surface 18 and includes a leading edge 24 and a trailing edge 26 that converge at a distal tip 28 of the blade. Likewise, blade 16 includes a root portion 30 that is joined to and extends partly about the circumferential hub surface 18. Blade 16 also includes a leading edge 32, an opposite trailing edge 34 and a tip portion 36 that is formed between edges 32 and 34. The tips 28 and 36 of blades 14 and 16, respectively, define the diameter of rotation of the propeller 10 as it is rotated by the boat motor. As best shown in FIGS. 2 and 3, blades 14 and 16 are joined to circumferential hub surface 18 and extend therefrom in a staggered, angled manner so that the propeller generates a forward thrust as it is driven by the motor.

As best shown in FIG. 1, the root portion of each blade extends more than 180 degrees about the circumferential hub surface 18. As a result, the root portions 23 and 30 overlap slightly and completely encircle hub surface 18. More particularly, leading edge 24 of blade 14 joins root portion 23 at a point 40 that is forward of a point 42 where trailing edge 34 of blade 16 joins root portion 30. The term "forward" refers to the direction, indicated by arrow 44, in which propeller 10 is driven during operation of the boat motor. Similarly, leading edge 32 of blade 16 is joined to its respective root portion 30 at a point 46 that is located forward of the point 48 where trailing edge 26 of blade 14 joins its respective root portion 23. In other words, a small segment 50 of blade 14 overlaps blade 16 and a similar small segment 52 of blade 16 overlaps blade 14.

Each of the leading edges 24 and 32 extends in a spiral configuration from circumferential hub surface 18 to its respective distal tip. In particular, leading edge 24 of blade 14 extends from point 40 to tip 28. Similarly, leading edge 32 of blade 16 extends from point 46 to tip 36. Leading edges 24 and 32 extend in a smooth arcuate fashion about the hub to a much greater extent than in previously known propellers. Preferably, each leading edge extends approximately 160 degrees about the hub and should extend at least 130 degrees.

Figure 4A:
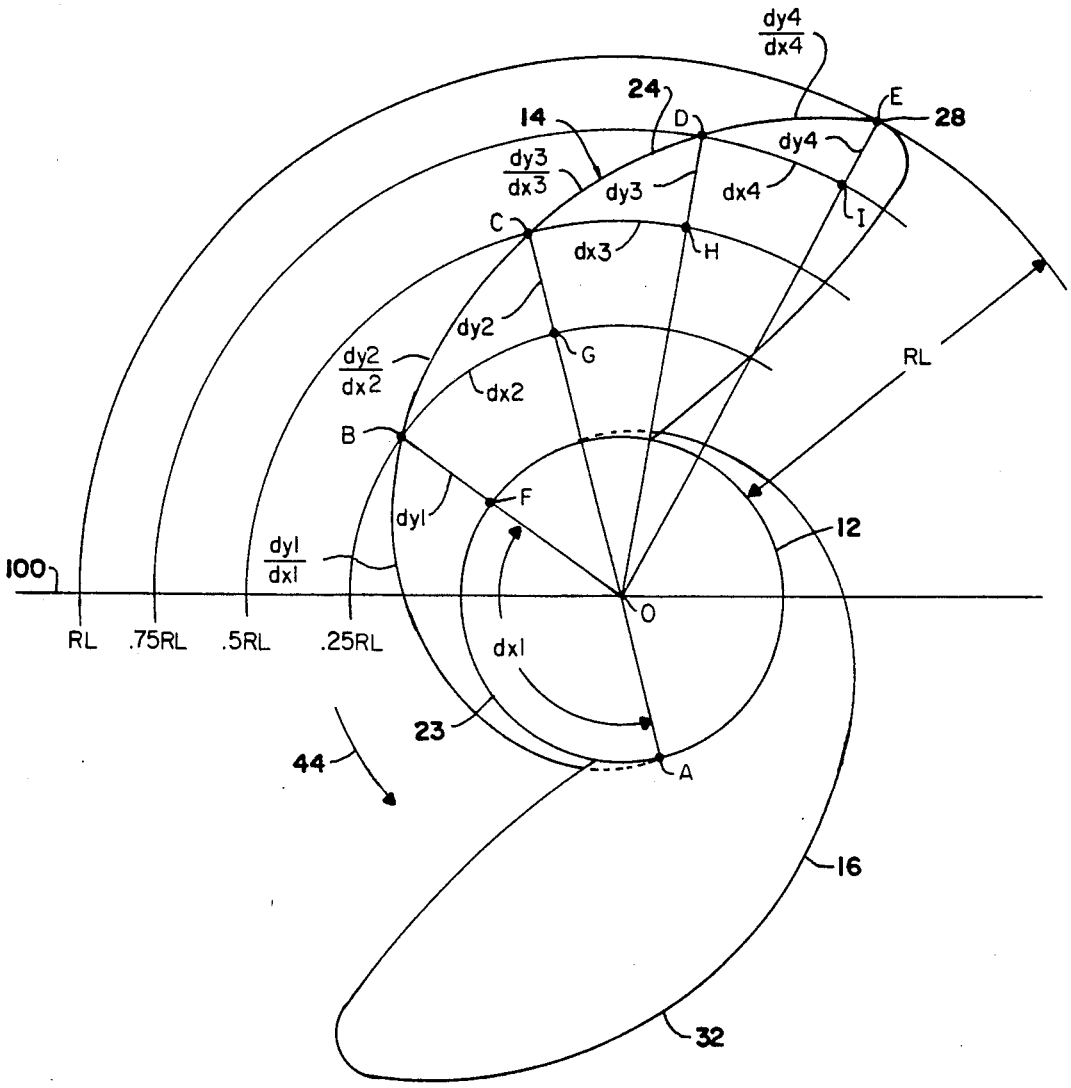
FIG. 4A is an elevational front view with a superimposed graph that illustrates the unique blade arc of this invention.
Figure 4B:
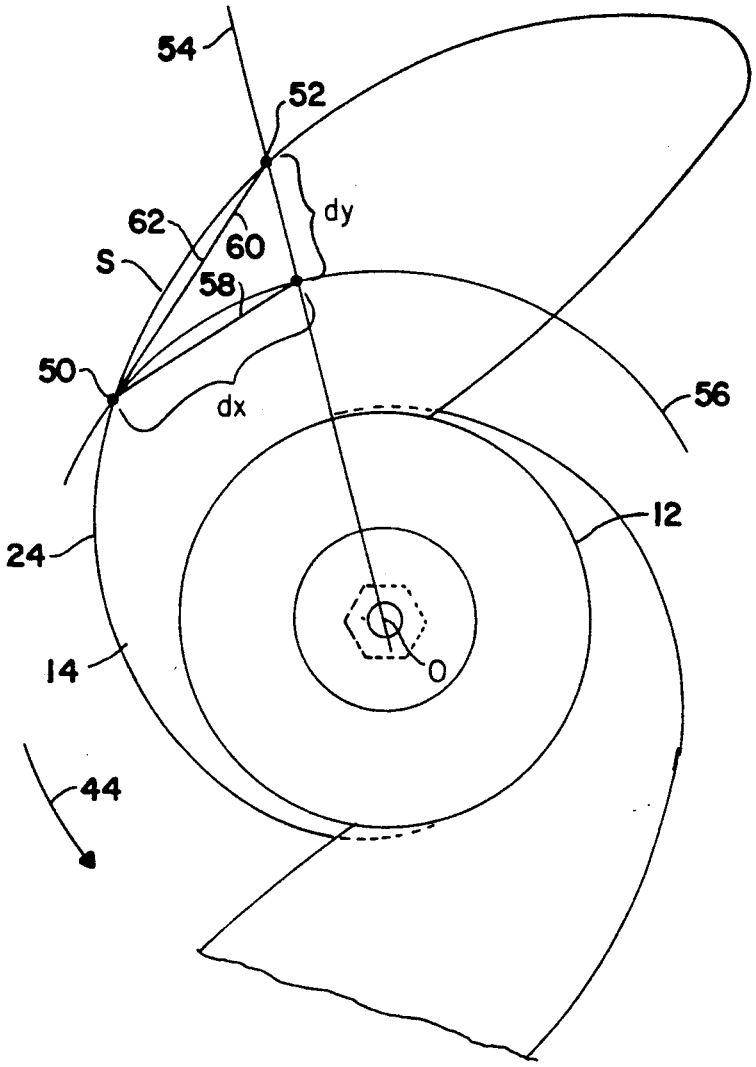
FIG. 4B is a partial elevational front view of the propeller that illustrates the wedge principle of this invention.

Leading edges 24 and 32 are curved in the manner described more fully in connection with FIGS. 4A and 4B. Therein this curvature is described for leading edge 24 of blade 14. However, it should be understood that identical principles apply to leading edge 32 of the other blade 16. A plurality of points A–E, FIG. 4A, are arranged along leading edge 24 to divide the leading edge into a plurality of segments AB, BC, CD and DE. It should be understood, however, that this number of points and segments are shown for illustrative purposes only and in fact, an infinite number of points and segments of varying sizes may be defined at elected locations along the leading blade edge. In this example, point A represents the point at which leading edge 24 joins circumferential hub surface 18 at blade root 23. Point B represents a point along leading edge 24 that is one quarter of the radial length RL of blade 14 from hub surface 18 to outer tip 28. Point C represents a point ½ the distance RL. Point D designates a point along edge 24 that is ¾ of radial length RL. Finally, point E represents the outer end of leading edge 24 coincident with distal blade tip 28 and located at the full radial length RL.

Each of the leading edge segments AB, BC, CD and DE exhibits a respective pitch, slope or incline. This is known as the segment's blade sweep or arc and is represented by the ratio dy/dx. This ratio is explained more fully in connection with FIG. 4B. Therein is depicted a selected segment S defined by points 50 and 52 and representative of all leading edge segments along the blade. As the propeller blade 14 is driven through the weeds and water, its leading edge 24 advances through successive segments S. That advance features two components of direction. The position of the blade changes radially relative to the center of the hub and circumferentially along a circular arc that extends between the leading and trailing edges and is concentric with the hub. More particularly, as shown in FIG. 4B, dy refers to the change of position of segment S in a first dimension generally along a radial line 54 that extends from the center O of hub 12; and dx refers to the change of position of the leading edge in a second dimension generally along a circular arc 56 that is concentric with hub 12 and extends from leading edge 24 to trailing edge 26. The arcuate distance dx and the arcuate leading edge segment S approximate straight lines 58 and 60, respectively, so that the leading edge segment S behaves virtually identically to an inclined plane or wedge 62. The slope of the inclined plane or wedge 62 corresponds quite closely to the arc dy/dx of segment S. Therefore, to calculate dy/dx, those dimensions may be measured directly. Or, the straight line distance of line segment 58 may be measured so that the slope of straight line 60 can be determined. Similarly at any point along segment S the blade arc may be determined by calculating the slope of the line tangent to the segment at that point. In all cases, the curve of edge 24 is sufficiently shallow such that this slope or ratio is less than 1 for each segment S and for all points along the leading edge. In fact, as described more fully below, dy/dy is significantly less than 1 and is not much greater than 0.5 for the entire leading edge of the blade. This ratio permits each leading edge segment S and the virtual wedge 62 formed thereby to advance effectively through weeds and underwater plant growth as the propeller is driven in the direction of arrow 44.

Referring again to FIG. 4A, as propeller 10 is rotated in the direction of arrow 44, each successive segment AB, BC, CD and DE is driven through a point of reference, for example, axis 100, such that the position of the leading edge changes in two dimensions dy and dx that define the blade arc for that segment. In FIG. 4A, dx and dy are accompanied by numerical designations 1, 2, 3 and 4, which correspond to individual leading edge segments AB, BC, CD and DE, respectively, More specifically, as segment AB is advanced through axis 100, the leading edge 24 advances radially from a point F along blade root 23 to point B. This distance is represented by dy1, which is equivalent to 0.25 RL. During the same time, the hub rotates a distance dx1. As a result, the blade arc for leading edge segment AB is dy1/dx1. Next, the blade advances segment BC through axis 100. During this phase, the position of leading edge 24 changes radially from point G, at 0.25 RL, to point C at 0.5 RL. This radial change in position is represented by dy2. Concurrently, the blade advances circumferentially along the circular arc designated by 0.25 RL from point B to point G for a distance of dx2. As a result, a blade arc of dy2/dx2 is exhibited by segment BC. Subsequently, leading edge segment CD is advanced through axis 100. During this phase, the radial component of change between point H at 0.5 RL and point D at 0.75 RL is dy3. The circumferential component of this change, along the arc designated by 0.5 RL between point C and point H is dx3 to provide a blade arc of dy3/dx3. Finally, the remaining segment DE is advanced through axis 100. The radial component of the blade arc for this segment is dy4, which is the distance between point I at 0.75 RL and point E at a distance RL. The circumferential component dx4 of segment DE is determined by the distance from point D to point I at 0.75 RL. This provides for the blade arc dy4/dx4.

As previously described, each of the blade arcs dy1/dx1, dy2/dx2, dy3/dx3 and dy4/dx4 has a value of less than 1, and preferably significantly less than 1. The following chart illustrates representative relative dimensional units (in any selected standard of measurement) that may be employed. It should be understood that these dimensions are illustrative only and do not limit this invention.

| | dy | dx | dy/dx |
|---|---|---|---|
| SEGMENT AB | 28 | 112 | ¼ |
| SEGMENT BC | 28 | 56 | ½ |
| SEGMENT CD | 28 | 49 | .57 |
| SEGMENT DE | 28 | 54 | .52 |

Accordingly, the blade arc within each of the segments AB, BC, CD and D of blade 14 is significantly less than 1. In fact, the maximum blade arc along leading edge 24 is not much greater than ½. Such a ratio likewise applies to any and all other selected segments and points along leading edge 24. Such an arc allows the blade to effectively wedge through the weeds as it is rotated by the motor. As the propeller blade advances, it wedges or pushes the weeds from the inner end of the blade toward the outer end so that the weeds are shed without entangling the blade. Such a result cannot be readily accomplished where the blade arc is equal to or greater than 1, as in conventional propeller blades.

Figure 5:
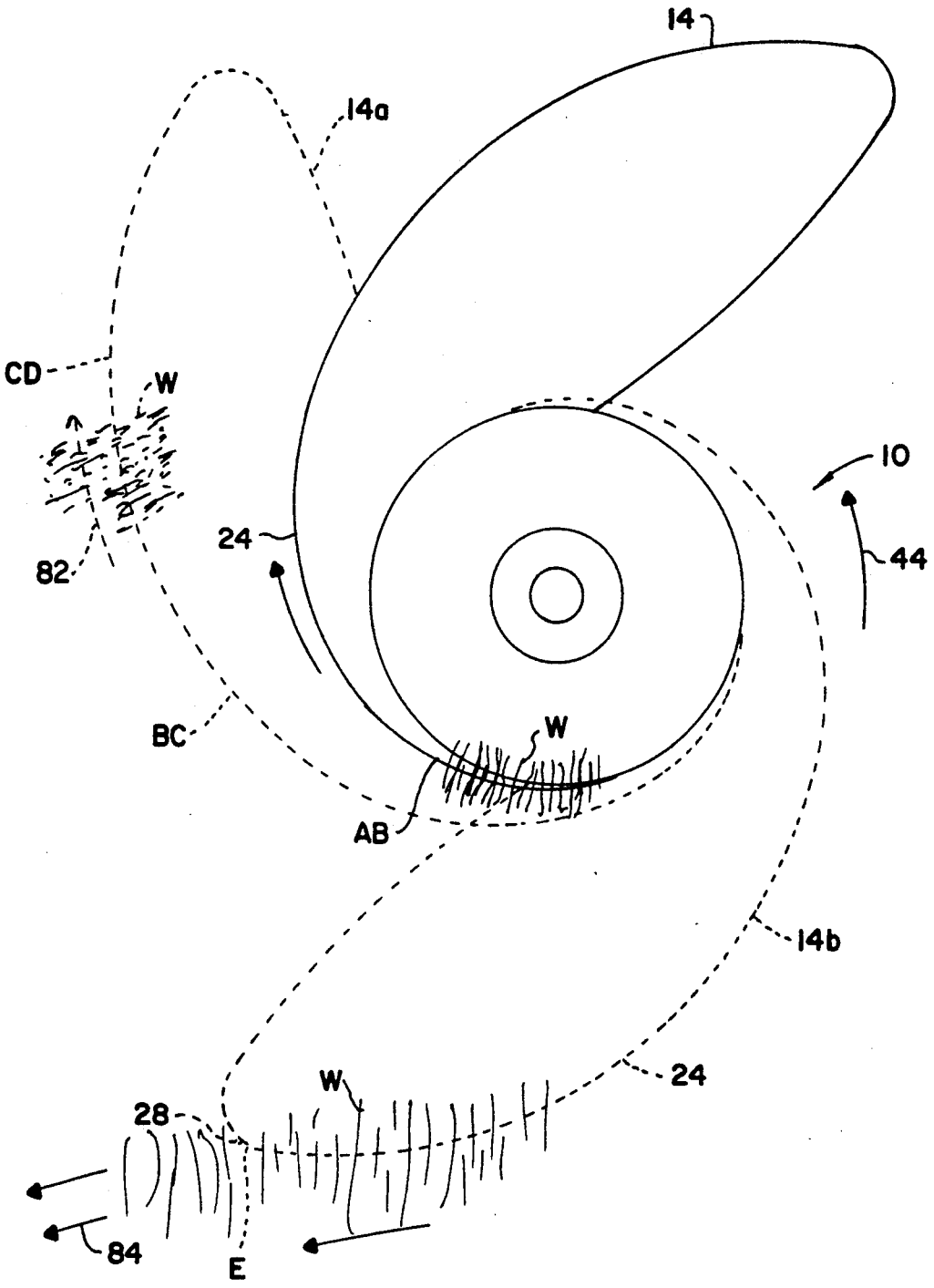
FIG. 5 is an elevational front view that illustrates the weedless wedging operation of the propeller of this invention.

Propeller 10 is shown in operation in FIG. 5. Therein, only a single blade 14 is illustrated for clarity. Blade 16, which is omitted, exhibits a similar operation. In particular, blade 14 first engages underwater weeds W proximate leading edge segment AB. As the blade rotates in the direction of arrow 44, the very shallow blade arc allows leading edge 24 of blade 14 to wedge through weeds W. As the blade advances into the position shown by phantom blade 14*a*, the weeds W are advanced along the leading edge in the direction of arrow 82. As a result, the weeds advance along blade segments BC and CD. Eventually, as the blade advances, for example to the position shown by phantom blade 14*b*, the weeds W are driven along leading edge 24 toward the distal end E of the leading edge. Finally, at some point during the rotation of blade 14, the weeds are ejected from the end of the blade, such as in the direction of arrows 84.

This illustration is not intended as a definitive representation of the precise point at which the weeds are thrown from the blade. In fact, weeds and other underwater plant growth may be advanced along and ejected from the propeller blades at varying rates and locations. The precise rate of advancement of the weeds along the leading edge is not a limitation of this invention. Rather, the critical feature is that the leading edge of each blade forms a wedge that progressively advances the weeds toward the distal tip 28 of the blade such that the weeds are effectively prevented from entangling the blades. A smooth, tangle-free operation is improved still further because of the unique sweep and arc of the blades. The outer edge of each blade extends for approximately 160 degrees about the hub. Additionally, the root of each blade extends for greater than 180 degrees about the hub such that the roots of the blades overlap and the entire circumference of the hub is surrounded by blades in the manner previously described. As a result, there are no circumferential spaces or gaps in the hub, which could otherwise collect and entangle with underwater plant growth. By eliminating such gaps and spaces, the present invention further minimizes the risk of entangling with weeds and exhibits an improved weedless operation.

The operation of applicant's invention is particularly effective for trolling motors and motors that employ a relatively low rpm. Tests have revealed that the propeller effectively resists entangling with in weeds even at very low speeds. Moreover, the propeller provides an improved amount of thrust at such low speeds. As a result, it can be used effectively for trolling applications, without frightening the fish. To employ the subject propeller for such uses, the hub is mounted and secured to the motor in the manner previously described. The boater then operates the motor in a conventional manner and preferably operates it between 200–1100 rpm. Most conventional motors operate at approximately 25–75% higher rpm. The propeller of this invention thus provides the improved weedless operation described above.

Although specific features of the invention are shown in some of the drawings and not others, this is for convenience only as each feature may be combined with any an all other features in accordance with this invention.

Other embodiments will occur to those skilled in the art and are within the following claims.

What is claimed is:

1. A weed resistant boat propeller comprising:

generally circular hub having a circumferential surface, said hub being adapted for mounting to and being rotatably driven by a boat motor; and a plurality of blades mounted to a circumferential surface of said hub and extending therefrom in a spiral configuration, each said blade including a curved leading edge that has an arc $dy/dx<1$ for the entire length of said leading edge, each blade further including a trailing edge, a root portion extending at least 180 degrees along said circumferential surface of said hub between said leading and trailing edges and a tip portion at the distal end of said blade between said leading and trailing edges.

2. The propeller of claim 1 in which a pair of blades are disposed symmetrically about said hub such that said leading edge of each said blade joins its respective root portion forwardly, with respect to the direction of travel of said hub, of a point wherein said leading edge of the other said blade joins the root portion of said other blade.

3. The propeller of claim 1 in which said blades are disposed such that said root portions of said blades completely encircle said hub.

4. The propeller of claim 1 in which said leading edge of each blade extends for at least 130 degrees about said circumferential surface of said hub.

5. The propeller of claim 1 in which said curved leading edge has an arc $dy/dx$ not greater than about 0.5 for the entire length of the leading edge.

6. A method of achieving weed resistant watercraft propulsion comprising the steps of:

operably mounting to a boat motor a weed resistent propeller, which propeller includes a generally circular hub adapted for mounting to and being rotatably driven by said motor and a plurality of blades mounted to a circumferential surface of said hub and extending therefrom in a generally spiral configuration, each blade including a curved leading edge that has an arc of $dy/dx<1$ for the entire length of said leading edge and extending for at least 130° about said circumferential surface of said hub; and rotatably driving said hub at a speed of between 200 and 1100 rpm such that said blades generate a forward thrust to propel the boat through the water while resisting entangling with weeds.

7. The method of claim 6 in which said blade is provided with a curved leading edge that has an arc of dy/dx not greater than about 0.5 for the entire length of the leading edge.

8. A weed resistant boat propeller comprising:

a generally circular hub having a circumferential surface, said hub being adapted for mounting to and being rotatably driven by a boat motor; and a plurality of blades mounted to a circumferential surface of said hub and extending therefrom in a spiral configuration, each said blade including a leading edge having an arc dy/dx less than 1 for the entire length of the blade and extending for at least 130° about said circumferential surface of said hub.

* * * * *